US010316599B2

(12) United States Patent
Paszek et al.

(10) Patent No.: US 10,316,599 B2
(45) Date of Patent: Jun. 11, 2019

(54) METHOD AND APPARATUS FOR THROUGH-TUBULAR SENSOR DEPLOYMENT

(71) Applicant: Scientific Drilling International, Inc., Houston, TX (US)

(72) Inventors: Nathan Thomas Paszek, Atascadero, CA (US); Benjamin Curtis Hawkinson, Paso Robles, CA (US)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 14/836,283

(22) Filed: Aug. 26, 2015

(65) Prior Publication Data

US 2016/0061023 A1 Mar. 3, 2016

Related U.S. Application Data

(60) Provisional application No. 62/042,491, filed on Aug. 27, 2014.

(51) Int. Cl.

| | |
|---|---|
| ***E21B 23/08*** | (2006.01) |
| ***E21B 23/10*** | (2006.01) |
| ***E21B 23/14*** | (2006.01) |

(52) U.S. Cl.

CPC ..... *E21B 23/08* (2013.01); *E21B 23/10* (2013.01); *E21B 23/14* (2013.01)

(58) Field of Classification Search

CPC ..... E21B 23/08

(Continued)

(56) References Cited

U.S. PATENT DOCUMENTS

| | | | |
|---|---|---|---|
| 3,606,926 | A | 9/1971 | Schwegman |
| 5,209,304 | A | 5/1993 | Nice |

(Continued)

FOREIGN PATENT DOCUMENTS

| | | | |
|---|---|---|---|
| WO | 0184040 | A1 | 11/2001 |

OTHER PUBLICATIONS

International Search Report and Written Opinion issued in Application No. PCT/US2015/046948, dated Nov. 23, 2015, 10 pages.

(Continued)

*Primary Examiner* — Anna M Momper
*Assistant Examiner* — Patrick F Lambe
(74) *Attorney, Agent, or Firm* — Adolph Locklar

(57) ABSTRACT

A landing nose adapted to deploy a sensor package within a tubular string may include one or more fins. The fins may be positioned to extend radially outwardly from the body of the landing nose and extend beyond the end of the landing nose body. The landing nose may be adapted to seat against a landing ring positioned within the tubular string. The fins may be adapted to, when the landing nose is seated, allow fluid to flow between the fins and through a central aperture of the landing ring. The fins may also be adapted to reduce the opportunity for the landing nose and sensor package to catch on any protrusions or features of the tubular string. In operation, the landing nose and sensor package may be run through the tubular string from the surface until the landing nose contacts the landing ring. The sensor package may then survey the wellbore as the tubular string is tripped-out from the wellbore.

25 Claims, 7 Drawing Sheets

(58) Field of Classification Search
USPC ..... 166/381
See application file for complete search history.

(56) References Cited

U.S. PATENT DOCUMENTS

| | | | | |
|---|---|---|---|---|
| 5,678,643 | A | 10/1997 | Robbins et al. | |
| 5,996,711 | A | 12/1999 | Ohmer | |
| 7,114,562 | B2 | 10/2006 | Fisseler et al. | |
| 7,188,688 | B1 * | 3/2007 | LeJeune | E21B 21/002 175/312 |
| 2003/0015319 | A1 * | 1/2003 | Green | E21B 23/04 166/250.01 |
| 2004/0168812 | A1 | 9/2004 | Watson et al. | |
| 2007/0227780 | A1 | 10/2007 | MacPherson et al. | |
| 2014/0124269 | A1 | 5/2014 | Logan et al. | |
| 2014/0144224 | A1 * | 5/2014 | Hoffman | E21B 33/134 73/152.18 |

OTHER PUBLICATIONS

Extended European Search Report issued in Application No. 15834846.6, dated Mar. 16, 2018, 10 pages.

* cited by examiner

METHOD AND APPARATUS FOR THROUGH-TUBULAR SENSOR DEPLOYMENT

CROSS-REFERENCE TO RELATED APPLICATIONS

This application is a nonprovisional application which claims priority from U.S. provisional application No. 62/042,491, filed Aug. 27, 2014.

TECHNICAL FIELD/FIELD OF THE DISCLOSURE

The present disclosure relates generally to the deployment of downhole tools in a wellbore, and specifically to deployment of surveying tools through a tool string in a wellbore.

BACKGROUND OF THE DISCLOSURE

Accurately and precisely determining the path of a wellbore is desirable, particularly when drilling deviated wells. Traditionally, a combination of sensors is used to measure downhole trajectory and subterranean conditions. Often, these sensors are included as part of the bottomhole assembly (BHA) of a drilling string. In some cases, however, a sensor package may be deployed into a wellbore through the interior of a tubular string after drilling of a wellbore is completed. In some cases, for example, the sensor package may be particularly susceptible to damage during a drilling operation. The sensor package may be deployed by gravity or by fluid pressure into the interior of the tubular string until it reaches a position at or near the BHA of the tubular string. Because of the relatively small interior diameter of the drill string, a guide or landing nose, referred to as a "bullnose", is typically utilized to, for example, help the sensor package navigate the interior of the drill string. The sensor package may then operate to measure or log as the tool string is removed or tripped-out of the wellbore.

SUMMARY

The present disclosure provides for a system for deploying a sensor package into a tubular string. The system may include a landing nose. The landing nose may be adapted to couple at a first end to the sensor package. The landing nose may include a landing nose body and one or more fins. The landing nose body may be generally cylindrical in shape. The fins may extend radially outwardly from the landing nose body and beyond a second end of the landing nose body. The system may also include a landing ring. The landing ring may be positioned within and coupled to the tubular string. The landing ring may include a central aperture adapted to allow fluid to pass therethrough. The landing ring may be adapted to prevent further travel of the landing nose within the tubular string.

The present disclosure also provides for a landing nose for guiding a sensor package through a tubular string. The landing nose may include a landing nose body. The landing nose body may be generally cylindrical in shape and may have a first and second end. The landing nose body may include a coupler at the first end adapted to couple to the sensor package. The landing nose may further include one or more fins. The fins may extend radially outwardly from the landing nose body and beyond the second end of the landing nose body.

The present disclosure also provides for a method for deploying a sensor package into a tubular string positioned in a wellbore. The method may include positioning a landing ring at a predetermined location in the tubular string. The landing ring may include a central aperture adapted to allow fluid to pass therethrough. The method may also include coupling a landing nose to the sensor package. The landing nose may be adapted to couple at a first end to the sensor package. The landing nose may include a landing nose body and one or more fins. The landing nose body may be generally cylindrical in shape. The fins may extend radially outwardly from the landing nose body and beyond a second end of the landing nose body. The fins may be adapted to prevent the landing nose from passing through the landing ring. The method may further include inserting the landing nose and sensor package into an open end of the tubular string. The method may further include running the landing nose and sensor package through the tubular string. The method may further include contacting the landing ring with at least a portion of the landing nose.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
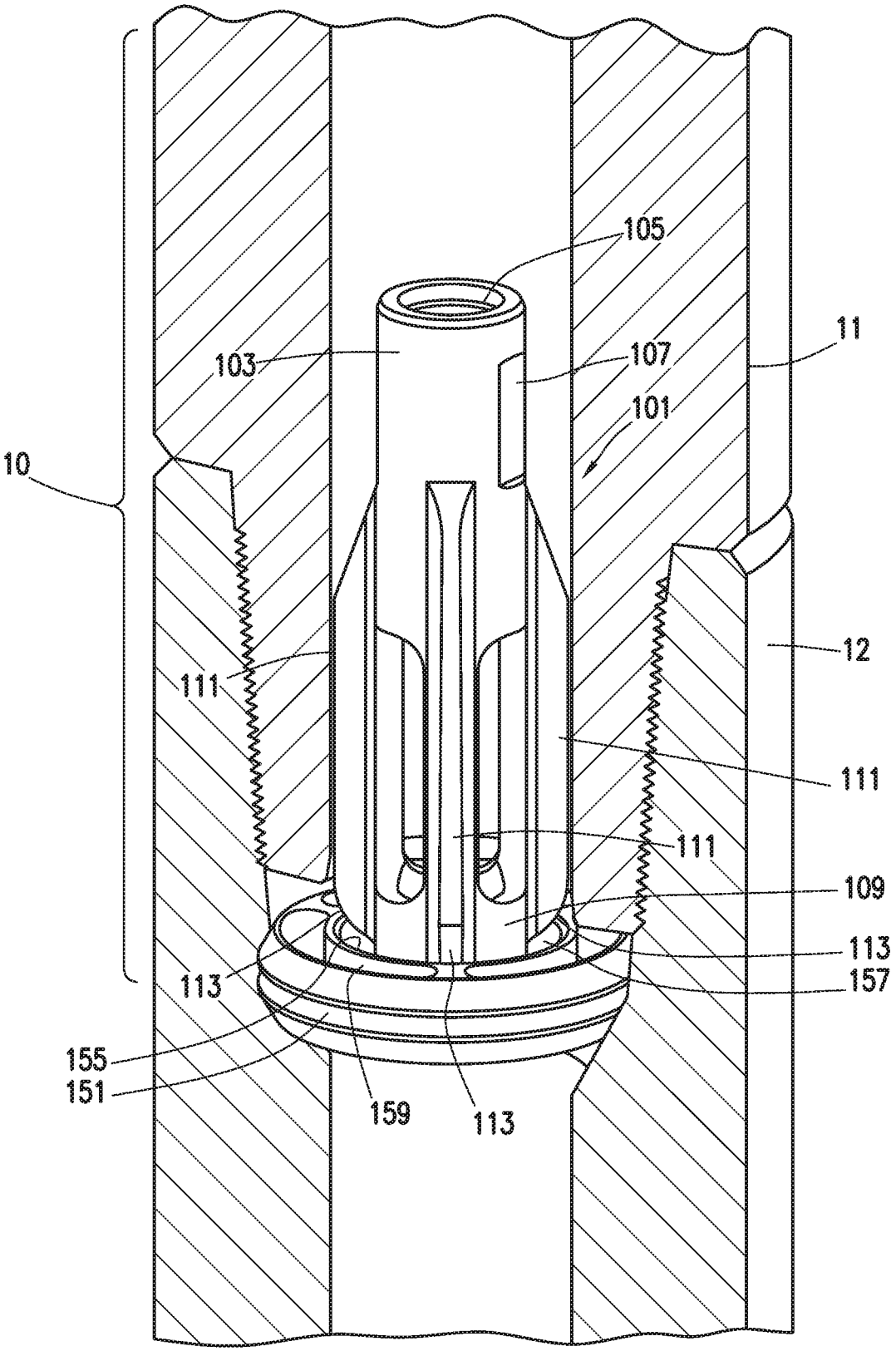
FIG. 1 depicts a landing nose and landing ring positioned within a tubular string in cross section consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

In some embodiments, as depicted in FIGS. 1, 2, 3*a*-3*c*, and 5, landing nose 101 may be adapted to be passed through the interior of a tubular string (partially displayed in cross section in FIG. 1 as tubular string 10). In some embodiments, tubular string 10 may, as understood in the art, be a drill string or tool string for use in a wellbore including a plurality of tubular segments joined end-to-end and extending through the wellbore. In some embodiments, landing nose 101 may be adapted to be coupled to sensor package 102 and lead sensor package 102 as sensor package 102 is inserted into and traverses the interior of tubular string 10.

In some embodiments, sensor package 102 may include one or more gyroscopic sensors 104 adapted to measure or survey the wellbore as tubular string 10 is withdrawn from the wellbore after sensor package 102 is positioned therewithin. In some embodiments, sensor package 102 may include memory 106 adapted to store data from the sensors 104 to be retrieved once sensor package 102 reaches the surface. One having ordinary skill in the art with the benefit of this disclosure will understand that sensor package 102 may include any sensors 104 for use within a tubular string within a wellbore. In some embodiments, landing nose 101 may be driven through tubular string 10 by gravity. In some embodiments, landing nose 101 may be driven through tubular string 10 by fluid pressure.

Figure 2:
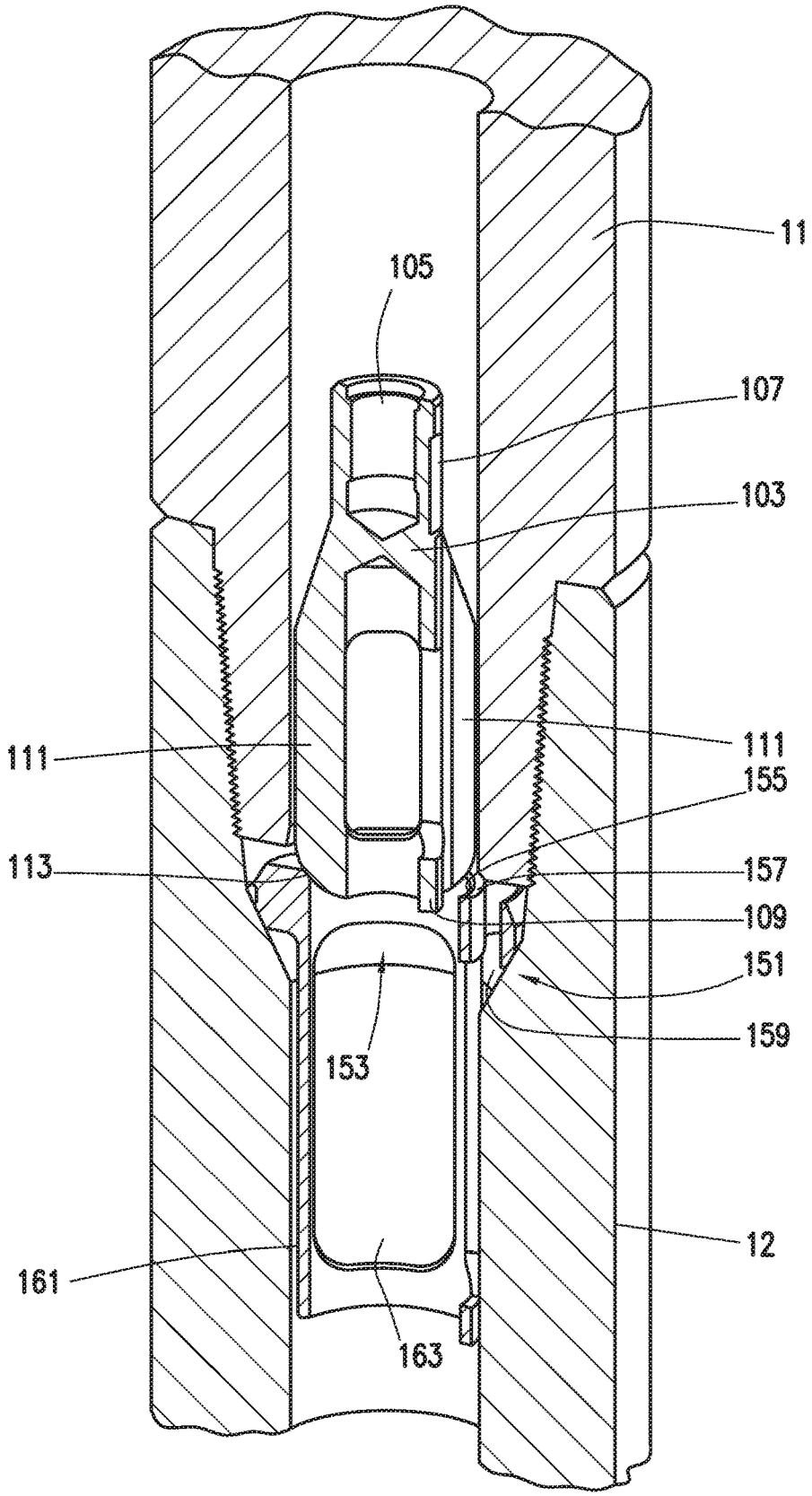
FIG. 2 depicts a cross section of the landing nose and landing ring of FIG. 1.
Figure 5:
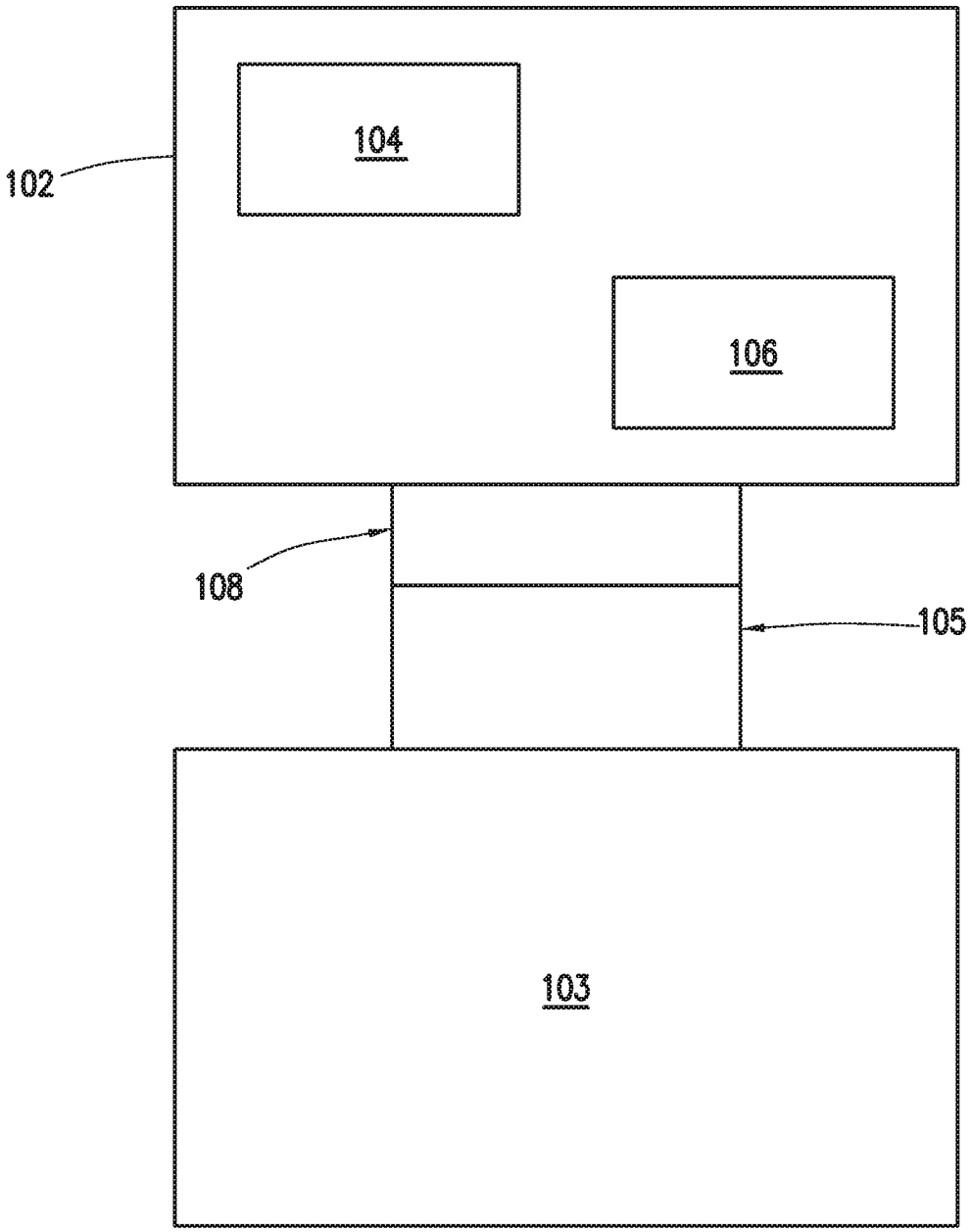
FIG. 5 depicts a schematic diagram of the sensor package coupled to the landing nose consistent with embodiments of the present disclosure.

In some embodiments, landing nose 101 may be a generally tubular member including landing nose body 103. In some embodiments, landing nose 101 may include coupler 105 adapted to allow the sensor package 102 to be coupled thereto. In some embodiments, as depicted in FIGS. 1, 2, and 5, coupler 105 may be a threaded coupler adapted to engage a mating coupler 108 so disposed on sensor package 102. In some such embodiments, landing nose 101 may include a feature to allow landing nose 101 to be threadedly coupled to sensor package 102, such as, for example and without limitation, wrench points 107. In some embodiments, wrench points 107 may also allow landing nose 101 to be oriented with respect to sensor package 102.

In some embodiments, landing nose 101 may include nose ring 109. Nose ring 109 may be positioned at the end of landing nose 101 opposite coupler 105 such that nose ring 109 leads landing nose 101 as landing nose 101 traverses through tubular string 10.

Figure 3A:
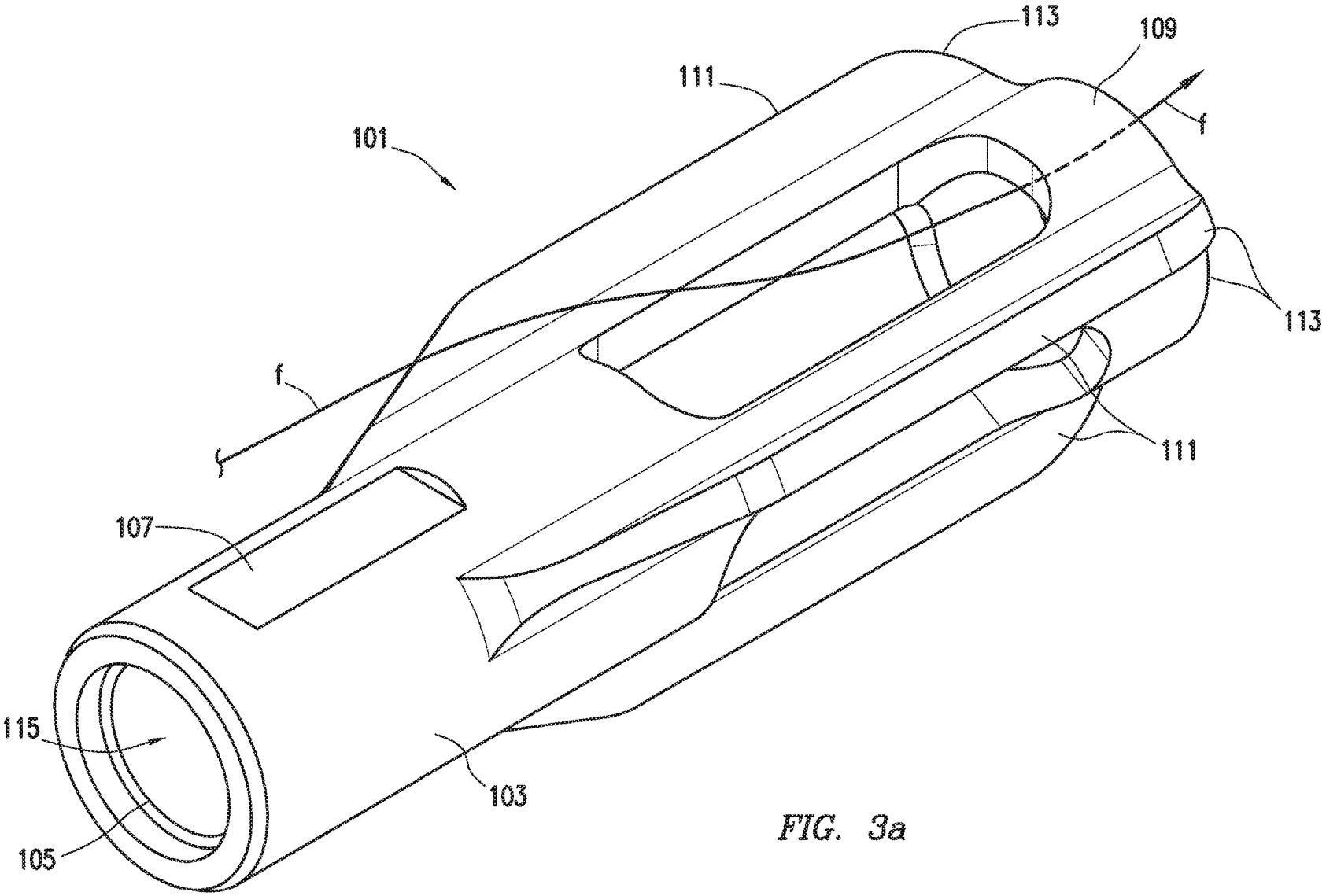
FIGS. 3*a*-3*c* depict various views of a landing nose consistent with embodiments of the present disclosure.
Figure 3C:
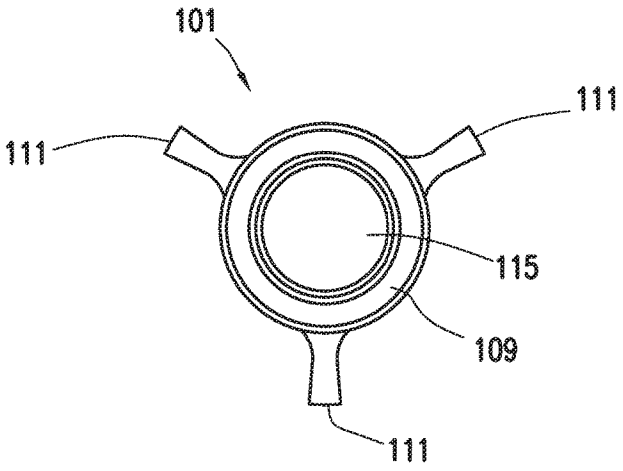
Figure 3B:
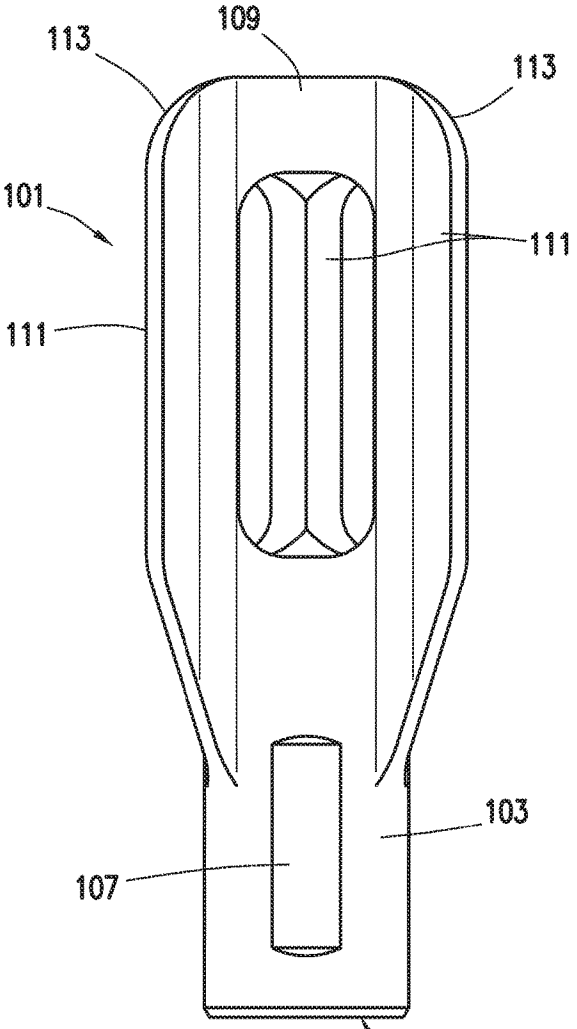

In some embodiments, nose ring 109 may be coupled to landing nose body 103 by one or more fins 111. In some embodiments, fins 111 may be generally evenly radially distributed about landing nose body 103 and nose ring 109. In some embodiments, fins 111 may extend radially outward from landing nose body 103 and nose ring 109. In some embodiments, the outer diameter of fins 111 may be selected to allow landing nose 101 and any sensor package to more easily traverse the interior of tubular string 10 while remaining oriented therewith and reduce opportunities for landing nose 101 to catch on any protrusions or features of tubular string 10. In some embodiments, fins 111 may include one or more features adapted to more easily allow landing nose 101 to pass through tubular string 10. For example and without limitation, in some embodiments, the outer diameter of fins 111 may reduce toward the end of fins 111. In some embodiments, each fin 111 may vary in thickness to reduce the overall outer diameter of fins 111. In some embodiments, fins 111 may include taper 113. In some embodiments, taper 113 may be flat, chamfered, or, as shown in FIGS. 3*a-c*, rounded. In some embodiments, taper 113 may be adapted to, for example, allow fins 111 to more easily pass any obstructions or protrusions within tubular string 10 as landing nose 101 traverses the interior thereof. In some embodiments, taper 113 may be located at or near the end of fins 111. In some embodiments, taper 113 may extend all or a portion of the full length of fins 111.

In some embodiments, nose ring 109 may be adapted to couple between fins 111 to, for example and without limitation, add structural support to fins 111. In some embodiments, nose ring 109 may have central aperture 115 extending therethrough. In some embodiments, central aperture 115 may be adapted to allow fluid to flow between fins 111 and through nose ring 109 along flow path f as illustrated in FIG. 3*a*.

In some embodiments, as depicted in FIGS. 1, 2, landing nose 101 may be adapted to seat on landing ring 151. Landing ring 151 may be included within tubular string 10 at a position near the BHA (not shown). In some embodiments, landing ring 151 may be coupled to tubular string 10 at a joint between adjacent tubular segments 11, 12. In other embodiments, landing ring 151 may be included as a sub adapted to be coupled between adjacent tubular segments 11, 12. In other embodiments, landing ring 151 may be included within a sub adapted to be coupled between a tubular segment and the BHA.

Figure 4B:
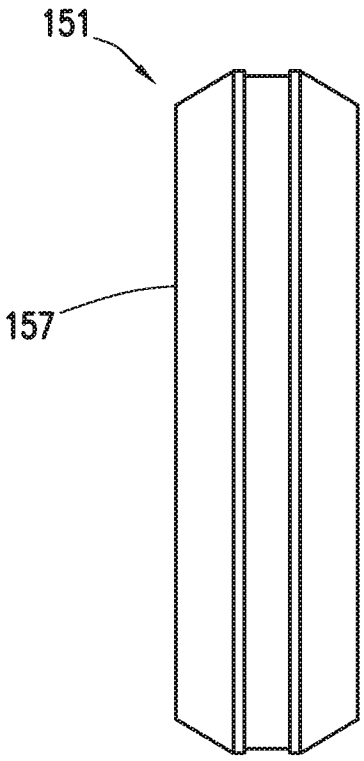
FIGS. 4*a*-4*c* depict various views of a landing ring consistent with embodiments of the present disclosure.
Figure 4A:
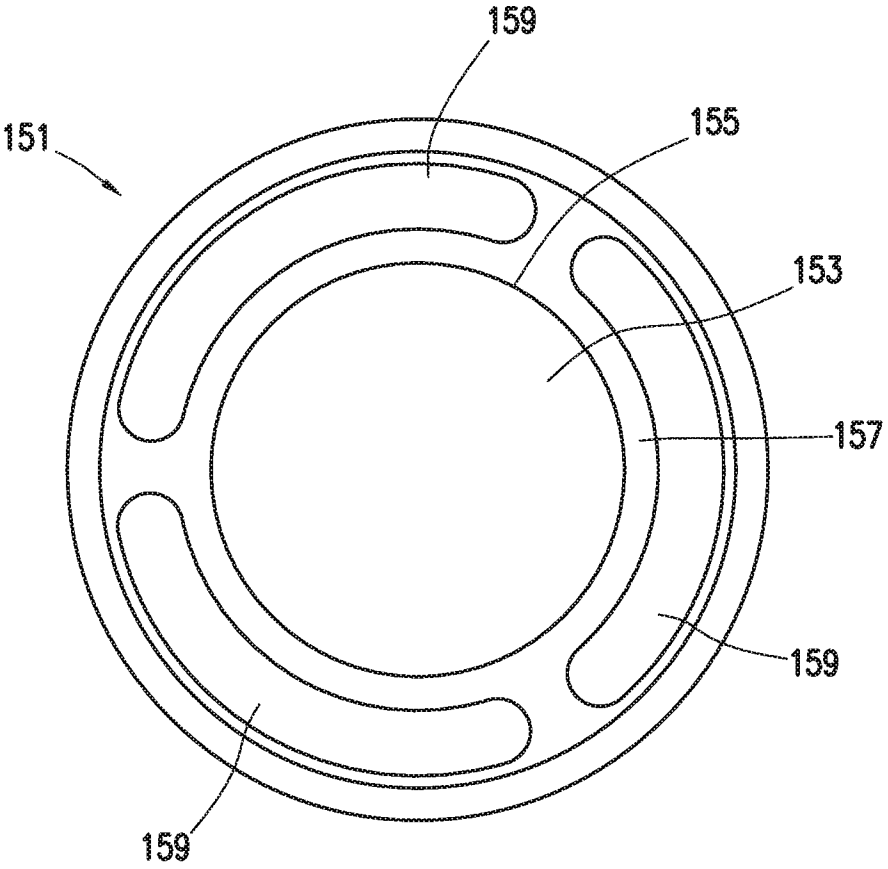
Figure 4C:
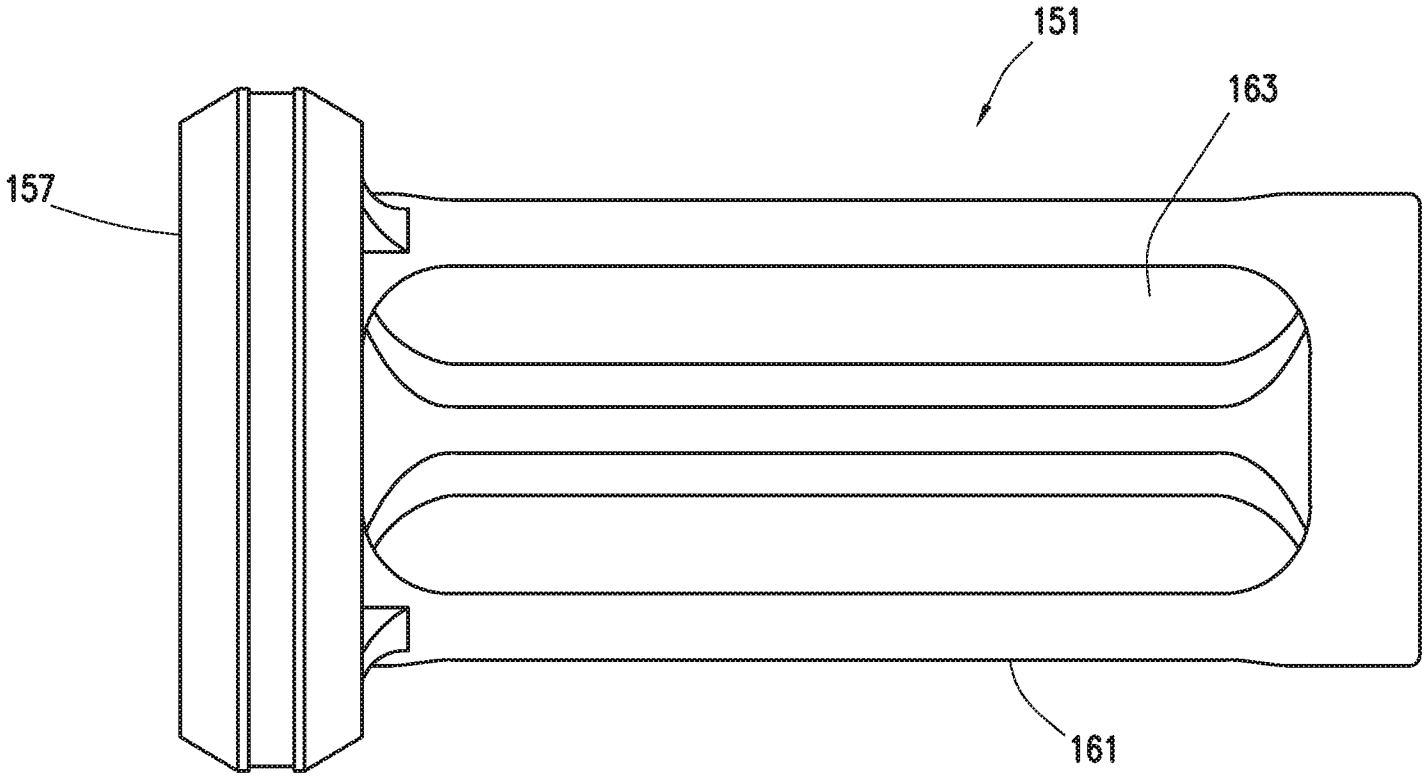

In some embodiments, as depicted in detail in FIGS. 4*a-c*, landing ring 151 may include central aperture 153. Central aperture 153 may be adapted to allow fluid to travel therethrough and continue through tubular string 10. In some embodiments, central aperture 153 may be adapted to further permit desired equipment, such as a control ball or control dart as understood in the art, to pass through landing ring 151. In some embodiments, central aperture 153 may include one or more features adapted to allow a control ball or control dart to more easily pass through landing ring 151. For example, in some embodiments, landing ring 151 may include tapered edge 155 the opening of central aperture 153 as shown in FIG. 2. In some embodiments, tapered edge 155 may be chamfered or rounded. Tapered edge 155 may, for example and without limitation, allow a control ball or control dart to more easily align with central aperture 153.

In some embodiments, landing ring 151 may include landing face 157 adapted to contact landing nose 101 as shown in FIGS. 1, 2. In some embodiments, landing face 157 may be adapted to contact fins 111. In some embodiments, landing face 157 may be adapted to contact nose ring 109. In some embodiments, landing face 157 may prevent landing nose 101 from extending farther through tubular string 10. In some embodiments, when landing nose 101 is positioned against landing ring 151, central aperture of nose ring 109 may be generally aligned with central aperture 153 of landing ring 151. In some such embodiments, fluid pumped through tubular string 10 may be capable of flowing through landing ring 151 through nose ring 109 and the openings between fins 111.

In some embodiments, as depicted in detail in FIG. 4*a*, landing ring 151 may include one or more peripheral flow paths 159 adapted to allow additional fluid to flow through landing ring 151.

In some embodiments, as depicted in FIGS. 2, 4*c*, landing ring 151 may include landing ring tail 161. Landing ring tail 161 may be adapted to at least partially fit against the interior of tubular segment 12 and, for example and without limitation, assist with orientation and installation of landing ring 151 in tubular segment 12. In some embodiments, landing ring tail 161 may be adapted to include a coupler (not shown) to engage with a matching locking feature (not shown) on the interior surface of tubular segment 12. In some embodiments, landing ring tail may include one or more windows 163 adapted to allow fluid to pass through windows 163 into the interior of landing ring tail 161. In some embodiments, windows 163 may be adapted to, for example and without limitation, prevent damage to tubular string 10 and landing ring tail 161 caused by high-speed fluid flow therebetween.

To further assist with the understanding of the use of landing nose 101 in accordance with embodiments of this disclosure, an exemplary operation for positioning a sensor package into tubular string 10 will now be described. Tubular string 10 may, as previously discussed, be a drill or tool string made up of a plurality of tubular segments. As tubular string 10 is made-up, defined as coupling additional tubular segments to tubular string 10 to extend the length of tubular string 10 as it is extended into the wellbore, landing ring 151 may be positioned within tubular string 10 at a desired location. In some embodiments, the desired location may be at or near the BHA. Once tubular string 10 is at a desired depth from tripping-in and/or drilling operations, a sensor package may be deployed into tubular string 10.

In some embodiments, to deploy the sensor package, landing nose 101 may be coupled to the sensor package. The sensor package and landing nose 101 may be positioned into an open end of tubular string 10 at the surface of the wellbore and allowed to travel therethrough. In some embodiments, the sensor package and landing nose 101 may travel by the force of gravity. In some embodiments, the sensor package and landing nose 101 may be driven by fluid pressure as fluid is pumped through tubular string 10. While landing nose 101 travels through tubular string 10, fins 111 may reduce opportunities for landing nose 101 to catch on any protrusions or features of tubular string 10 as previously discussed. In some embodiments, in which fins 111 include tapers 113, tapers 113 may further reduce opportunities for landing nose 101 to catch on any protrusions or features of tubular string 10.

Once landing nose 101 reaches landing ring 151, at least a portion of landing nose 101 may contact landing ring 151. Landing ring 151 may prevent landing nose 101 from travelling further through tubular string 10. Once landed, fins 111 may provide a flow path for fluid to flow between fins 111 and through central aperture 153 of landing ring 151 as previously discussed.

The sensor package may then be activated to begin surveying as tubular string 10 is tripped-out of the wellbore. Landing ring 151 may retain the sensor package and landing nose 101 in position within tubular string 10 as tubular string 10 is tripped-out from the wellbore. During the tripping-out procedure, the sensor package may continue to survey the wellbore and surrounding formation as previously discussed and may store data to be retrieved at the surface. Once the sensor package reaches the surface, it may be removed from tubular string 10, and the data may be retrieved.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole deployment system, the system comprising:

a sensor package to be deployed through the interior of a tubular string from an open end of the tubular string after the tubular string is positioned in a wellbore;

a landing nose, the landing nose coupled with a coupler at a first end to the sensor package, the landing nose including a landing nose body and two or more fins, the landing nose body being generally cylindrical in shape and including a coupler, the fins extending radially outwardly from the landing nose body and extending beyond a second end of the landing nose body, the second end of the landing nose body opposite the first end of the landing nose body, wherein an opening between adjacent fins of the two or more fins defines a flow path between a position radially outward of the landing nose body and a position radially within the two or more fins beyond the second end of the landing nose body; and a landing ring, the landing ring positioned within and coupled to the tubular string, the landing ring including a central aperture adapted to allow fluid to pass therethrough, the landing ring adapted to prevent further travel of the landing nose within the tubular string.

2. The system of claim 1, wherein the landing nose further comprises a nose ring, the nose ring positioned at the end of the fins opposite the landing nose body, the nose ring adapted to couple between the fins.

3. The system of claim 1, wherein the landing nose body comprises the coupler at its first end, the coupler of the landing nose body adapted to allow the sensor package to couple to the landing nose body.

4. The system of claim 3, wherein the coupler of the landing nose body comprises a threaded coupler.

5. The system of claim 4, wherein the landing nose body further comprises a wrenching point adapted to allow the landing nose to be threadedly coupled to the sensor package.

6. The system of claim 4, wherein the landing nose body further comprises a wrenching point adapted to allow the landing nose to be oriented with respect to the sensor package.

7. The system of claim 1, wherein, while positioned within the tubular string, the fins create a flow path for fluid travelling through the tubular string such that the fluid travels between the fins and through the central aperture of the landing ring.

8. The system of claim 1, wherein the central aperture of the landing ring is further adapted to allow desired equipment to pass therethrough.

9. The system of claim 8, wherein the desired equipment comprises at least one of a control ball or control dart.

10. The system of claim 1, wherein the landing ring further comprises at least one peripheral flow path adapted to allow fluid to pass through the peripheral flow path in addition to the central aperture.

11. The system of claim 1, wherein the fins of the landing nose further comprise an inward taper toward the end of the fins opposite the landing nose body.

12. The system of claim 1, wherein the landing ring further comprises a landing ring tail, the landing ring tail adapted to extend into a tubular segment of the tubular string into which the landing ring is installed, the landing ring tail adapted to provide stability for the insertion and orientation of the landing ring as the landing ring is installed into the tubular segment.

13. An apparatus comprising:

a landing nose for guiding a sensor package through a tubular string after the tubular string is positioned in a wellbore, the landing nose comprising:

a landing nose body, the landing nose body being generally cylindrical in shape and having a first and second end, the landing nose body including a coupler at the first end coupled to the sensor package; and two or more fins, the fins extending radially outwardly from the landing nose body and extending beyond the second end of the landing nose body, the second end of the landing nose body opposite the first end of the landing nose body, wherein an opening between adjacent fins of the two or more fins defines a flow path between a position radially outward of the landing nose body and a position radially within the two or more fins beyond the second end of the landing nose body.

14. The landing nose of claim 13, wherein the landing nose further comprises a nose ring, the nose ring positioned at the end of the fins opposite the landing nose body, the nose ring adapted to couple between the fins.

15. The landing nose of claim 13, wherein the coupler comprises a threaded coupler.

16. The landing nose of claim 15, wherein the landing nose body further comprises a wrenching point adapted to allow the landing nose to be threadedly coupled to the sensor package.

17. The landing nose of claim 13, wherein, while positioned within the tubular string, the fins create a flow path for fluid travelling through the tubular string such that the fluid travels between the fins.

18. The landing nose of claim 13, wherein the fins of the landing nose further comprise an inward taper toward the end of the fins opposite the landing nose body.

19. A method comprising:

deploying a sensor package into a tubular string positioned in a wellbore by:

positioning a landing ring at a predetermined location in the tubular string, the tubular string having an interior, the landing ring including a central aperture adapted to allow fluid to pass through the landing ring;

positioning the tubular string in the wellbore;

coupling a landing nose to the sensor package, the landing nose coupled at a first end to the sensor package, the landing nose including a landing nose body and two or more fins, the landing nose body being generally cylindrical in shape and including a coupler disposed on the first end, the fins extending radially outwardly from the landing nose body and extending beyond a second end of the landing nose body, the second end of the landing nose body opposite the first end of the landing nose body, wherein an opening between adjacent fins of the two or more fins defines a flow path between a position radially outward of the landing nose body and a position radially within the two or more fins beyond the second end of the landing nose body, the fins adapted to prevent the landing nose from passing through the landing ring;

inserting the landing nose and sensor package into an open end of the tubular string after the tubular string is positioned in the wellbore;

running the landing nose and sensor package through the interior of the tubular string; and contacting the landing ring with at least a portion of the landing nose.

20. The method of claim 19, further comprising:

activating the sensor package;

tripping out the tubular from the wellbore until the sensor package is at the surface; and recovering data from the sensor package.

21. The method of claim 19, further comprising:

pumping a fluid through the tubular string such that the fluid flows between the fins of the landing nose and through the central aperture of the landing ring.

22. The method of claim 19, wherein the running operation comprises at least one of allowing gravity to pull the sensor package and landing nose through the tubular string and pumping fluid through the tubular string.

23. A downhole deployment system, the system comprising:

a sensor package to be deployed through the interior of a tubular string from an open end of the tubular string after the tubular string is positioned in a wellbore;

a landing nose, comprising a first end comprising a coupler, a second end comprising a nose ring having a ring aperture, a landing nose body, the coupler disposed on the landing nose body, and two or more fins, each comprising an extending end and a tapered end, the landing nose body being generally cylindrical in shape, the fins extending radially outwardly from the exterior surface of the landing nose body at the extending end and extending beyond a bottom end of the landing nose body and coupling to the nose ring at the tapered end, wherein an opening between adjacent fins of the two or more fins defines a flow path between a position radially outward of the landing nose body and a position radially within the two or more fins beyond the second end of the landing nose body, wherein the landing nose is coupled to the sensor package by the coupler at a top end of the landing nose body, the top end of the landing nose body opposite the bottom end of the landing nose body; and a landing ring, the landing ring positioned within and coupled to the tubular string, the landing ring including a central aperture adapted to allow fluid to pass therethrough, the landing ring adapted to prevent further travel of the landing nose within the interior of the tubular string.

24. The downhole deployment system of claim 23 wherein the landing ring further comprises a landing face in direct communication with the tapered end of the one or more fins.

25. The downhole deployment system of claim 23 wherein the landing ring further comprises a landing face in direct communication with the nose ring.

* * * * *